US006348027B1

(12) United States Patent
Lee

(10) Patent No.: US 6,348,027 B1
(45) Date of Patent: Feb. 19, 2002

(54) EXERCISE WHEEL

(76) Inventor: Chin-Tsun Lee, No. 32, Lane 6, Kuokuang 7th St., Yung Kang City, Tainan Hsien (TW)

( * ) Notice: Subject to any disclaimer, the term of this patent is extended or adjusted under 35 U.S.C. 154(b) by 0 days.

(21) Appl. No.: 09/637,150

(22) Filed: Aug. 14, 2000

(51) Int. Cl.[7] ..... A63B 21/00

(52) U.S. Cl. ..... 482/132; 482/127; 482/95; 482/96

(58) Field of Search ..... 482/132, 127, 482/96, 95, 148, 121, 126, 116, 907

(56) References Cited

U.S. PATENT DOCUMENTS 3,752,475 A * 8/1973 Ott ..... 482/127
6,017,296 A * 1/2000 Tang et al. ..... 482/132
6,146,318 A * 11/2000 Kuo ..... 482/132
6,254,518 B1 * 7/2001 Yu ..... 482/132

FOREIGN PATENT DOCUMENTS

DE 20007533 U1 * 8/2000 ..... 482/132

* cited by examiner

*Primary Examiner*—Jerome Donnelly
(74) *Attorney, Agent, or Firm*—Charles E. Baxley

(57) ABSTRACT

An exercise wheel comprises a housing, two grip rods secured to two sides of the housing, respectively, a chassis housed by the housing, and two wheel assemblies. Each wheel assembly comprises a shaft mounted between two side walls of the chassis, two wheels mounted in the housing and connected by the shaft to thereby allow rotational movement of the wheels, and a torsion spring. The torsion spring has a coil portion mounted around the shaft, a first end securely attached to one of the wheels, and a second end securely attached to one of the housing and the chassis. Rotational movement of the wheels in a forward direction is stopped when the torsion spring is twisted such that the coil portion of the torsion spring is in contact with an outer periphery of the shaft. A sleeve is mounted around the coil portion of the torsion spring to prevent radial outward expansion of the coil portion when the wheels are moved in a direction opposite to the forward direction.

8 Claims, 8 Drawing Sheets

EXERCISE WHEEL

BACKGROUND OF THE INVENTION

1. Field of the Invention

The present invention relates to an exercise wheel that has a stronger returning torque and improved stability while stopping further forward movement of the exercise wheel. The present invention also relates to an exercise wheel that is reduced in a manufacture cost thereof and that prevents radial outward expansion of the torsion springs to thereby prevent damage to the torsion springs resulting from operation of the exercise wheel in the wrong direction.

2. Description of the Related Art

FIGS. 6 and 7 of the drawings illustrates a conventional exercise wheel that includes a housing 1', two grip rods 2', a main gear 3', two roller pairs 4', and two torsion springs 5'. The housing 1' includes a compartment with a downwardly facing opening and aligned holes 11' on two sides thereof into which the grip rods 2' are mounted. Two stop rods 12' are mounted inside the housing 1'. The main gear 3' is mounted to the grip rods 2' and includes a peg 32' on each side thereof. Each roller pair 4' includes two rollers 41' connected by a shaft 42' that has teeth 421' formed on an outer periphery thereof for meshing with teeth 31' of the main gear 3'. Each torsion spring 5' includes two ends 52' and 53' that are attached to an associated peg 32' and an associated stop rod 12', respectively.

When in use, the user bends downward and grasps the grip rods 2' to make roller pairs 4' to roll on the ground. During rolling of the roller pairs 4', the torsion springs 5' are tensioned by the main gear 3' via transmission of the teeth 421' and 31'. When the main gear 3' is turned for one turn such that the end 52' of the torsion spring 51' bears against the stop rod 12', and the main gear 3' and the roller pairs 4' are thus stopped. The torsion springs 51' may return the exercise wheel to its initial position.

Nevertheless, assembly of the exercise wheel is time-consuming and costly, as a force must be provided to overcome the torsion springs 5' while assembling the main gear 3'. In addition, when the user operates the main gear 3' in the wrong direction, the torsion springs 5' might be damaged, as the torsion springs are twisted in the wrong direction, as shown in FIG. 8.

SUMMARY OF THE INVENTION

It is an object of the present invention to provide an exercise wheel that may limit the maximum travel of the exercise wheel.

It is another object of the present invention to provide an exercise wheel that may prevent damage to the torsion springs when the exercise wheel is operated in the wrong direction.

It is a further object of the present invention to provide an exercise wheel that provides higher returning force to the wheel assemblies of the exercise wheel.

In accordance with a first aspect of the invention, an exercise wheel comprises:

a housing having two sides, two grip rods secured to the two sides of the housing, respectively, a chassis housed by the housing and including two side walls, and two wheel assemblies each comprising:

a shaft mounted between the side walls of the chassis, two wheels mounted in the housing and connected by the shaft to thereby allow rotational movement of the wheels, and a torsion spring having a coil portion mounted around the shaft, a first end securely attached to one of the wheels, and a second end securely attached to one of the housing and the chassis, whereby rotational movement of the wheels in a forward direction is stopped when the torsion spring is twisted such that the coil portion of the torsion spring is in contact with an outer periphery of the shaft.

A tube may be mounted between the shaft and the coil portion of the torsion spring. A sleeve may be mounted around the coil portion of the torsion spring to prevent radial outward expansion of the coil portion when the wheels are moved in a direction opposite to the forward direction. Each wheel of each wheel assembly includes an engaging groove for engaging with an associated end of the sleeve.

In accordance with a second aspect of the invention, an exercise wheel comprises: a housing, a chassis housed by the housing and including two side walls, a grip rod extended through the housing and the side walls of the chassis, and a wheel assembly comprising:

two wheels mounted between the side walls of the chassis and around the grip rod to thereby allow rotational movement of the wheels, and a torsion spring having a coil portion mounted around the grip rod, a first end securely attached to one of the wheels, and a second end securely attached to one of the housing and the chassis, whereby rotational movement of the wheels in a forward direction is stopped when the torsion spring is twisted such that the coil portion of the torsion spring is in contact with an outer periphery of the grip rod.

Other objects, advantages, and novel features of the invention will become more apparent from the following detailed description when taken in conjunction with the accompanying drawings.

DETAILED DESCRIPTION OF PREFERRED EMBODIMENTS

Figure 1:
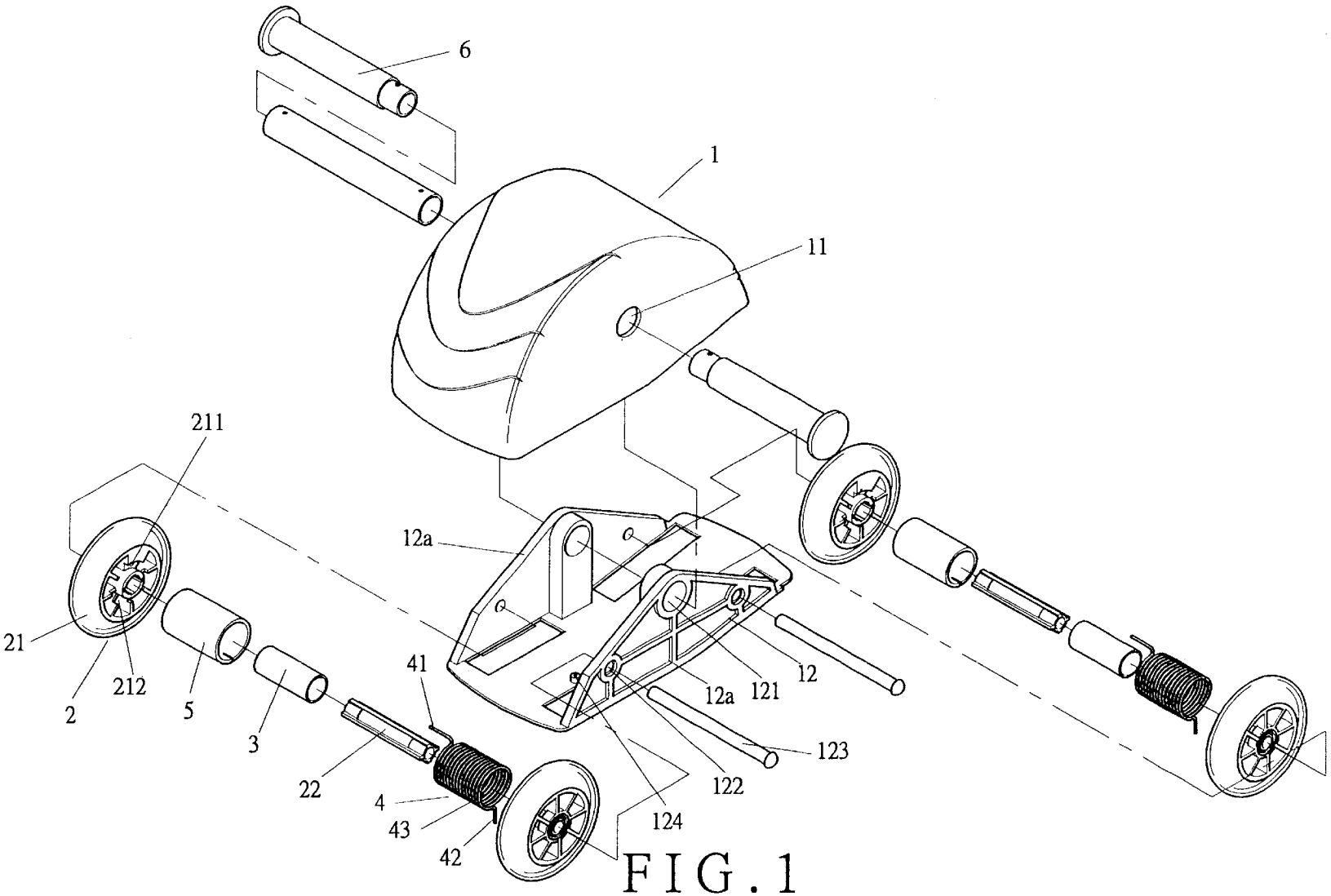
FIG. 1 is an exploded perspective view of an exercise wheel in accordance with the present invention.
Figure 2:
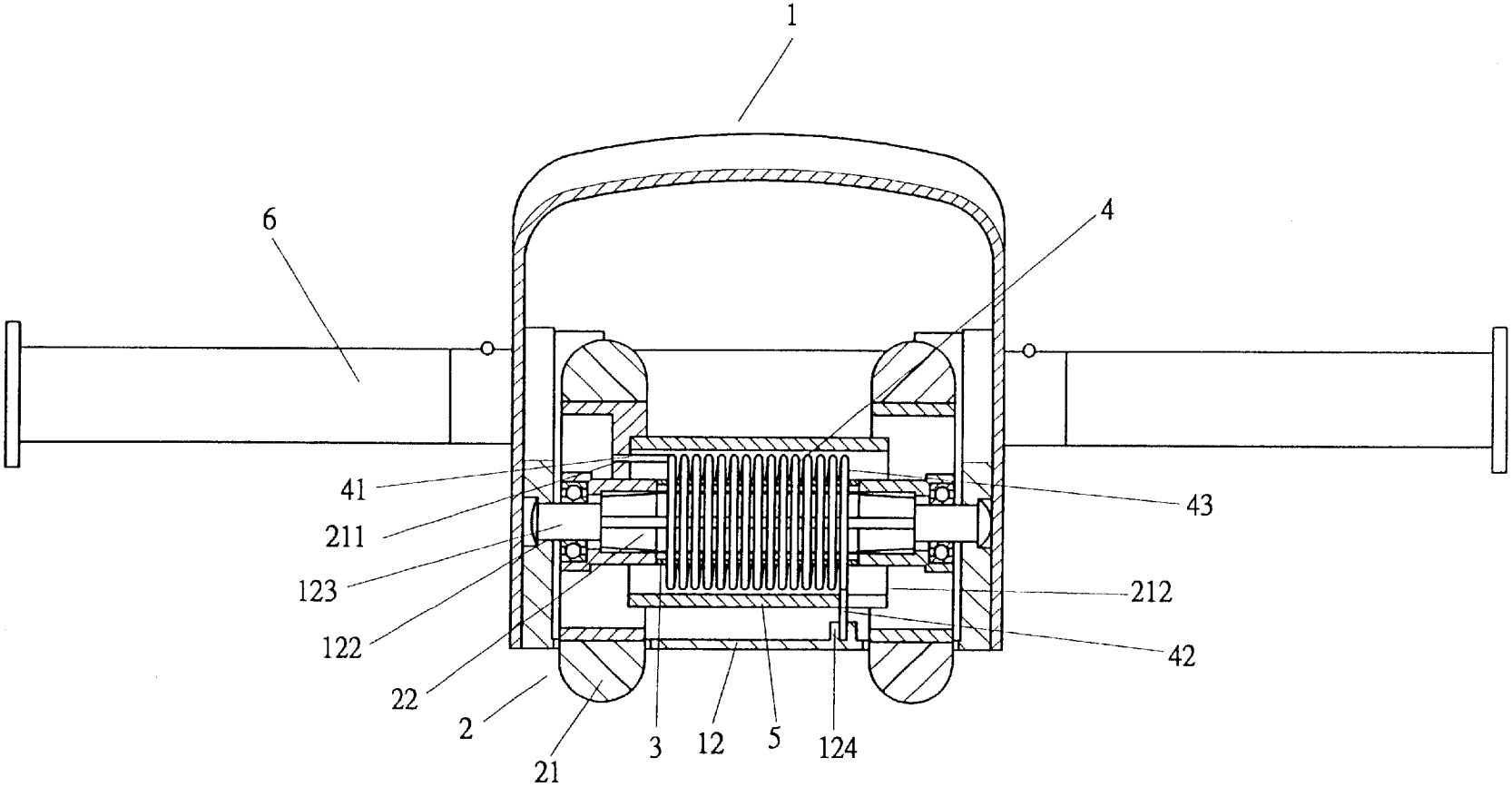
FIG. 2 is a sectional view of the exercise wheel in FIG. 1.

Referring to FIGS. 1 through 5 and initially to FIGS. 1 and 2, a first embodiment of an exercise wheel in accordance with the present invention generally includes a housing 1, a chassis 12, two wheel assemblies 2, and two grip rods 6. The housing 1 includes aligned holes 11 in two sides thereof for mounting the grip rods 7. The chassis 12 includes two side walls 12*a* having aligned pin holes 122 for receiving pins 123 and aligned axle holes 121 for mounting the grip rods 7, respectively.

Each wheel assembly 2 includes a pair of wheels 21 connected by a hollow shaft 22, which, in turn, is mounted around an associated pin 123, thereby allowing rotational movement of the wheels 21. Each wheel 21 includes an engaging groove 212, and two ends of an outer sleeve 5 are respectively mounted in the engaging grooves 212 of a pair of wheels 21. One of each pair of wheels 21 includes an engaging hole 211 for engaging with an end 41 of a spring 4.

A tube 3 is mounted around each hollow shaft 22 and is preferably made of abrasion-resistant material. A torsion spring 4 is mounted around a mediate portion of each tube 3 and includes a first end 41 securely attached to the engaging hole 211 of an associated wheel 21 and a second end 42 securely attached to an engaging hole 124 of the chassis 12. Each torsion spring 4 further includes a coil portion 43 of the type the inner diameter of the coil portion 43 reduces when the coil portion 43 is twisted in a direction. Each outer sleeve 5 has an inner diameter slightly greater than the outer diameter of the coil portion 43 of an associated torsion spring 4. Two ends of each outer sleeve 5 are engaged with the engaging grooves 212 of an associated pair of wheels 21.

Figure 3:
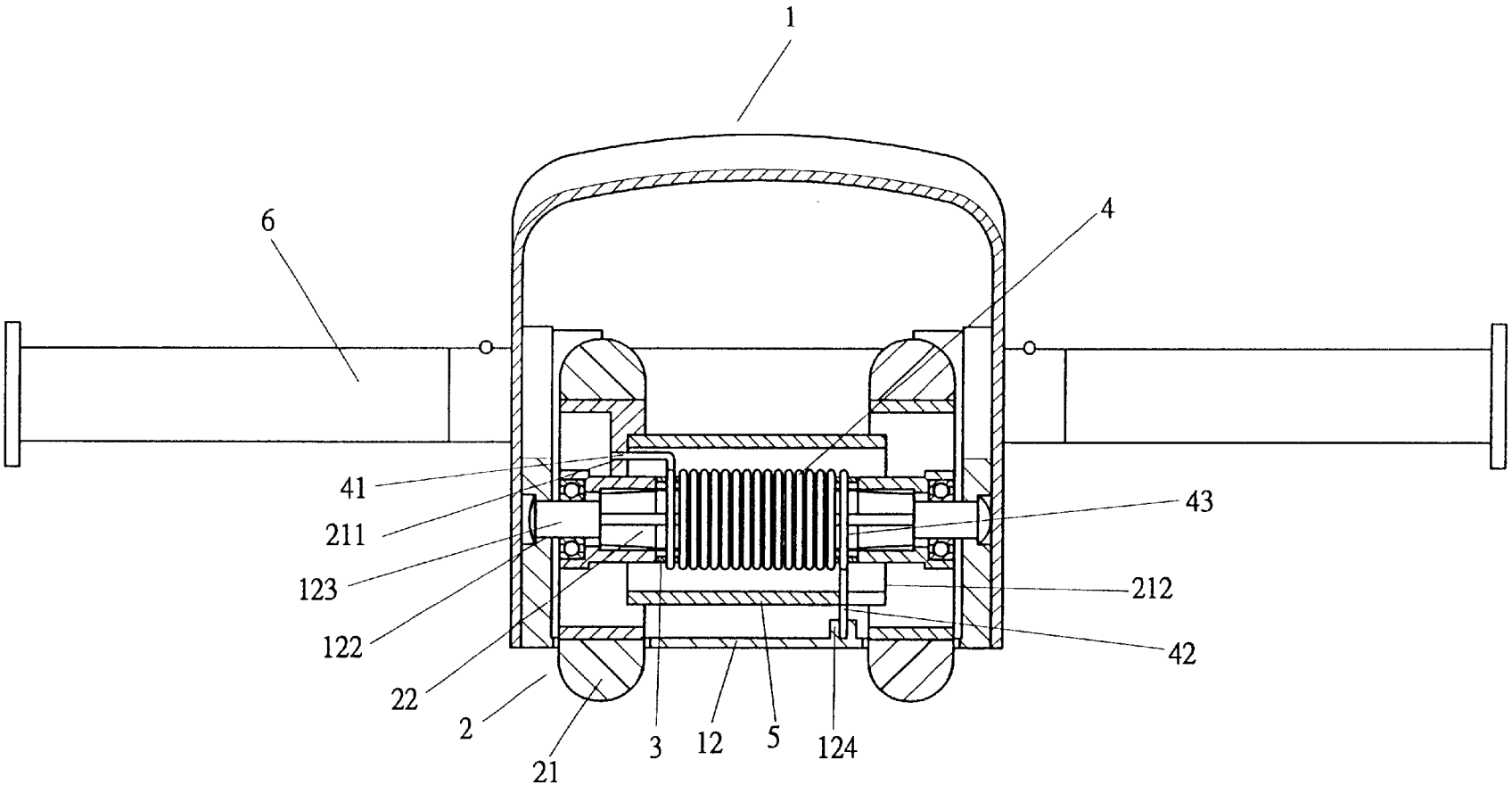
FIG. 3 is a sectional view similar to FIG. 2, illustrating forward travel of the exercise wheel.

When the exercise wheel is moved in a forward direction, as shown in FIG. 3, each torsion spring 4 is twisted in the above-mentioned direction during rotation of the associated pair of wheels 21 such that the inner diameter of each torsion spring 4 is reduced and thus in contact with the outer periphery of the associated tube 3. Thus, the maximal travel of the exercise wheel is limited, as the wheels 21 cannot rotate further. Each sleeve 5 assures location of the associated torsion spring 4 in the central portion between the wheels 21 of the associated wheel assembly 2, prevents undesired shifting of the torsion spring 4, and increases operational smoothness. Further, when the exercise wheel is returned to its initial position, the wheel assemblies are returned under the action of the torsion springs 4. This provides a force-saving effect for next operation.

Figure 4:
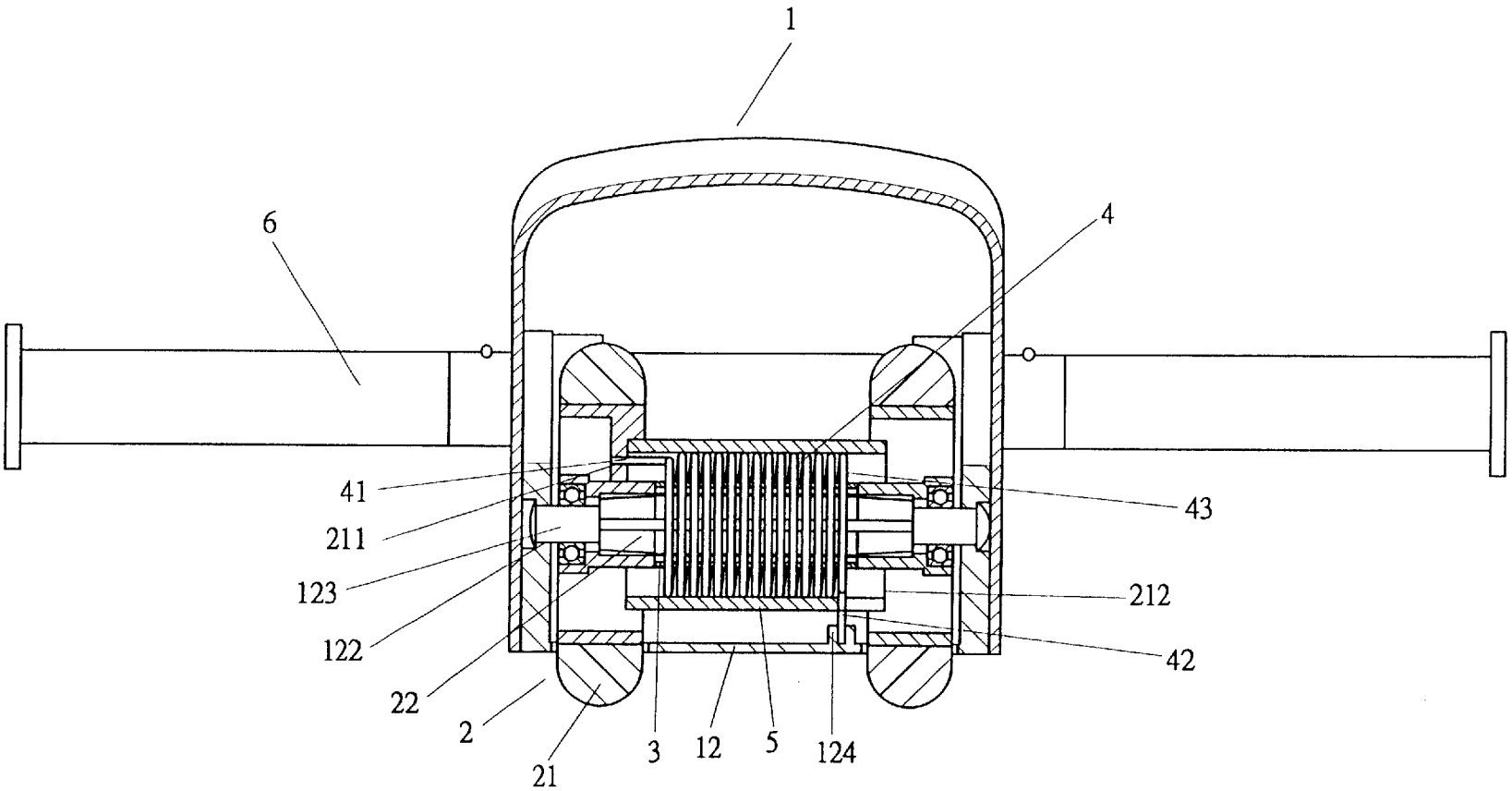
FIG. 4 is a schematic view similar to FIG. 2, illustrating reverse travel of the exercise wheel.

Referring to FIG. 4, when the user operates the exercise wheel in the wrong direction (namely, in a direction opposite to the above-mentioned direction), the torsion springs 4 are expanded radially outward, yet the sleeves 5 prevents such radial outward expansion and thus prevent damage to the torsion springs 4.

The tubes 3 may be omitted; namely, the torsion spring 4 may be directly mounted around the hollow shaft 2 without adversely affecting the function and operation.

Figure 5:
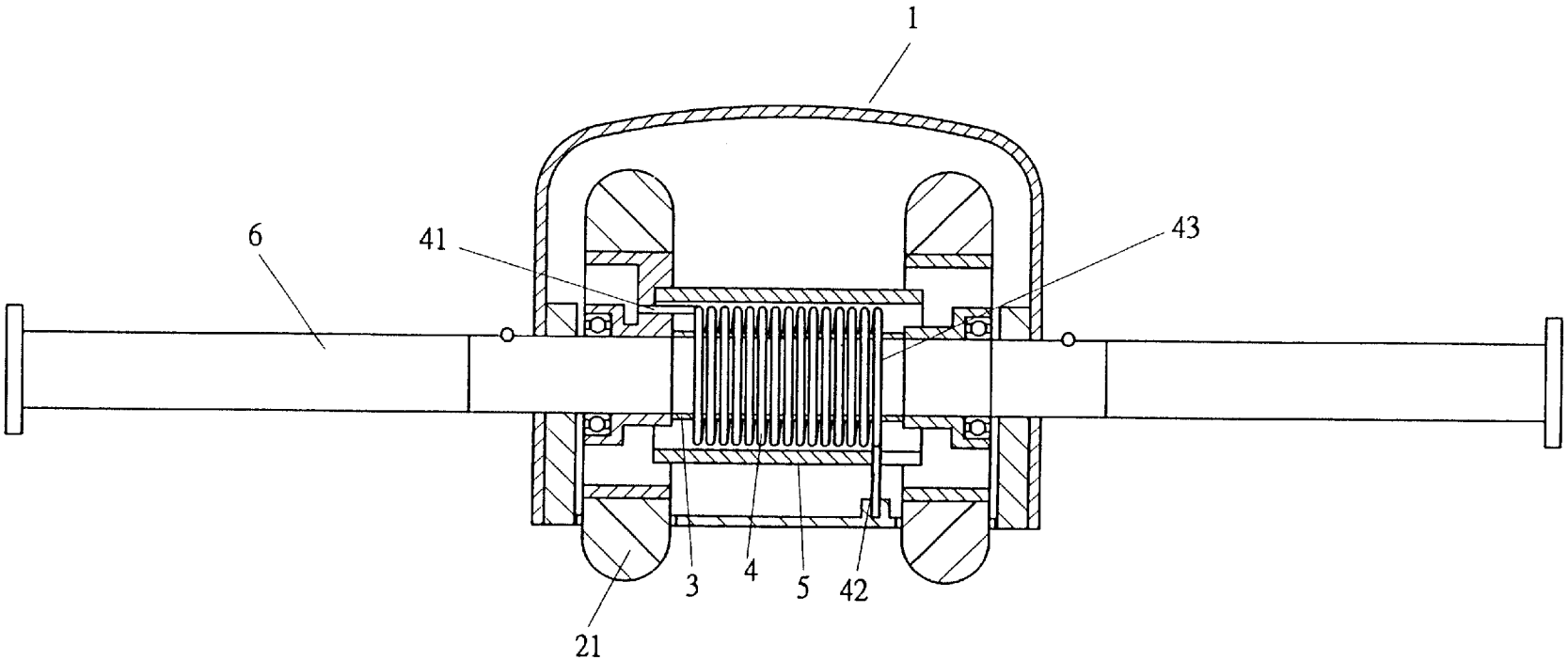
FIG. 5 is a sectional view of a modified embodiment of the exercise wheel in accordance with the present invention.
Figure 6:
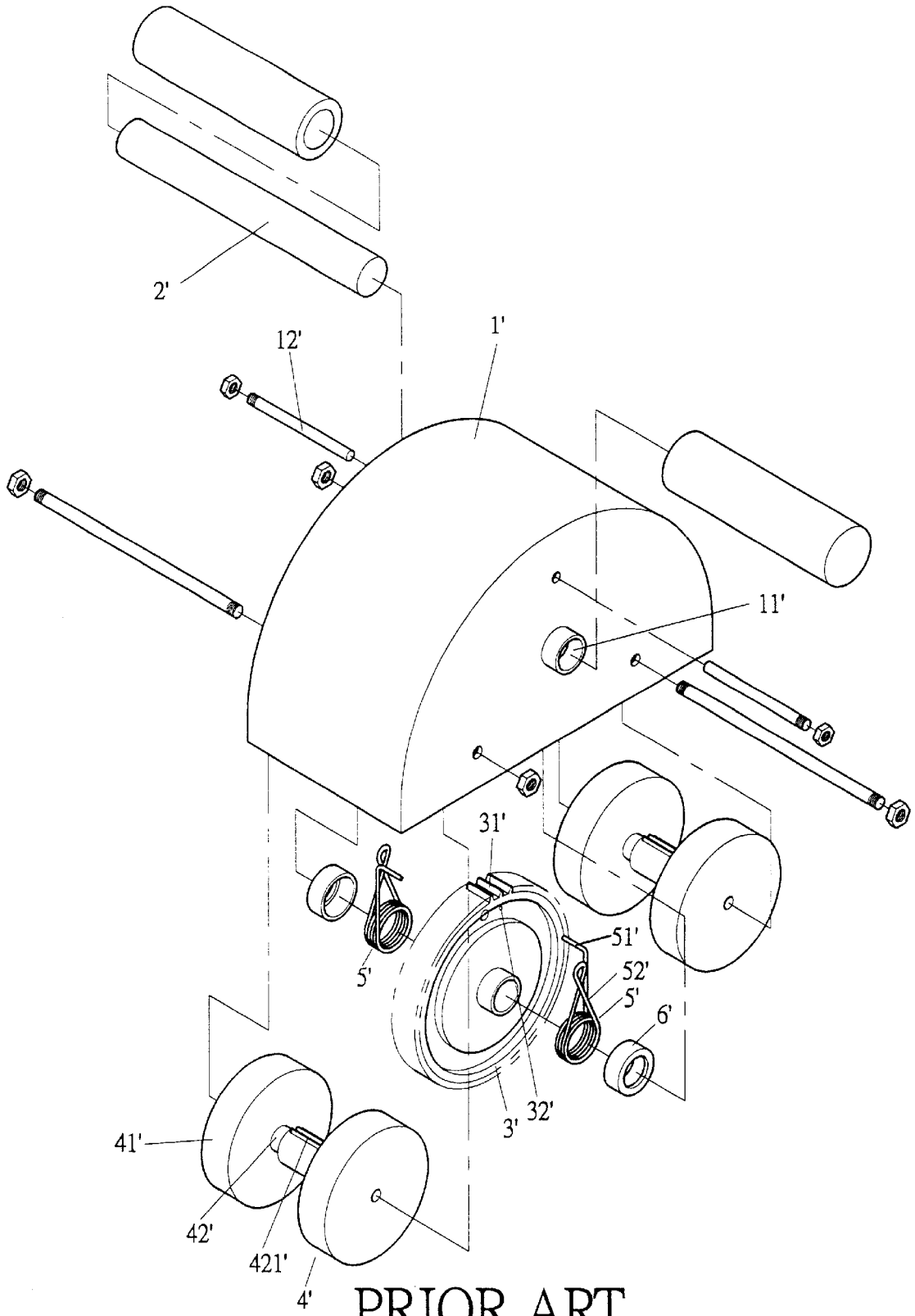
PRIOR ART FIG. 6
FIG. 6 is an exploded perspective view of a conventional exercise wheel.
Figure 7:
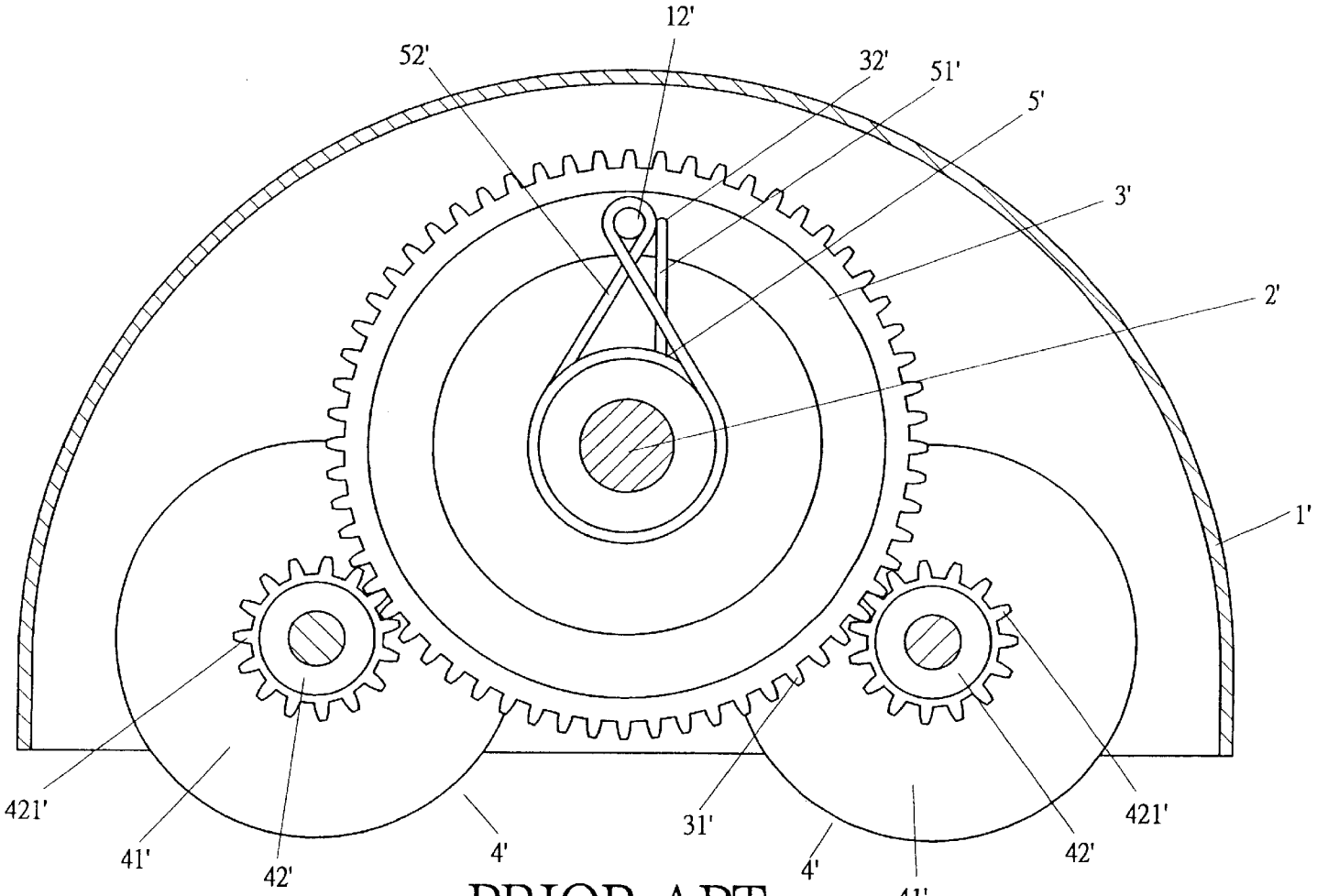
PRIOR ART FIG. 7
FIG. 7 is a sectional view of the conventional exercise wheel.
Figure 8:
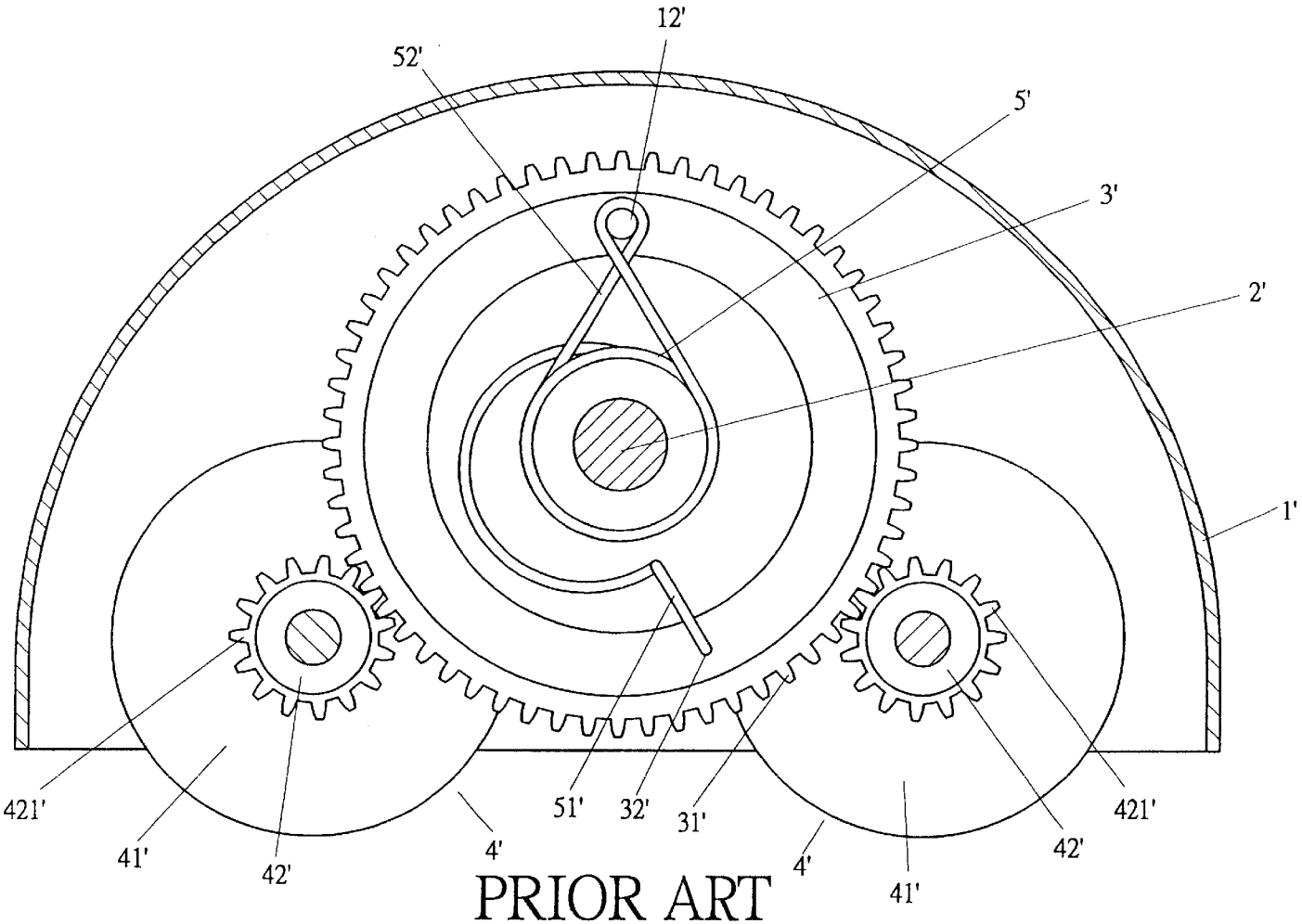
PRIOR ART FIG. 8
FIG. 8 is a sectional view illustrating reverse travel of the conventional exercise wheel.

FIG. 5 illustrates a modified embodiment, wherein two wheels 21 are mounted to the housing 1, and a tube 3 is mounted around a central portion of a single grip rod 6 that may consist of two grip rod sections. In addition, two ends of a single torsion spring 4 are securely attached to an associated wheel 21 of a single wheel assembly 2 and the housing 1. During forward movement of the exercise wheel, the coil portion 43 of the torsion spring 4 is moved to be in contact with the outer periphery of the tube 3 to limit the maximum travel of the exercise wheel.

According to the above description, it is appreciated that the exercise wheel includes the following advantages when compared with the conventional exercise wheel:

1. The torsion spring is directly twisted by the associated wheel assembly to provide higher returning torque and force-saving operation.
2. The coil portion of the torsion spring is used to prevent further forward movement of the exercise wheel.
3. The sleeve prevents damage to the torsion spring by means of preventing radial outward expansion of the coil portion of the torsion spring.
4. The exercise wheel includes simple elements and thus can be assembled easily to thereby reduce the manufacture cost.

Although the invention has been explained in relation to its preferred embodiment, it is to be understood that many other possible modifications and variations can be made without departing from the spirit and scope of the invention as hereinafter claimed.

What is claimed is:

1. An exercise wheel comprising:

a housing having two sides, two grip rods secured to the two sides of the housing, respectively, a chassis housed by the housing and including two side walls, and two wheel assemblies each comprising:

a shaft mounted between the side walls of the chassis, two wheels mounted in the housing and connected by the shaft to thereby allow rotational movement of the wheels, and a torsion spring having a coil portion mounted around the shaft, a first end securely attached to one of the wheels, and a second end securely attached to one of the housing and the chassis, whereby rotational movement of the wheels in a forward direction is stopped when the torsion spring is twisted such that the coil portion of the torsion spring is in contact with an outer periphery of the shaft.

2. The exercise wheel as claimed in claim 1, further comprising a tube mounted between the shaft and the coil portion of the torsion spring.

3. The exercise wheel as claimed in claim 1, further comprising a sleeve mounted around the coil portion of the torsion spring to prevent radial outward expansion of the coil portion when the wheels are moved in a direction opposite to the forward direction.

4. The exercise wheel as claimed in claim 3, wherein the sleeve includes two ends, and wherein each said wheel of each said wheel assembly includes an engaging groove for engaging with an associated said end of the sleeve.

5. An exercise wheel comprising:

a housing, a chassis housed by the housing and including two side walls, a grip rod extended through the housing and the side walls of the chassis, and a wheel assembly comprising:

two wheels mounted between the side walls of the chassis and around the grip rod to thereby allow rotational movement of the wheels, and a torsion spring having a coil portion mounted around the grip rod, a first end securely attached to one of the wheels, and a second end securely attached to one of the housing and the chassis, whereby rotational movement of the wheels in a forward direction is stopped when the torsion spring is twisted such that the coil portion of the torsion spring is in contact with an outer periphery of the grip rod.

6. The exercise wheel as claimed in claim 5, further comprising a tube mounted between the shaft and the coil portion of the torsion spring.

7. The exercise wheel as claimed in claim 5, further comprising a sleeve mounted around the coil portion of the torsion spring to prevent radial outward expansion of the coil portion when the wheels are moved in a direction opposite to the forward direction.

8. The exercise wheel as claimed in claim 7, wherein the sleeve includes two ends, and wherein each said wheel of said wheel assembly includes an engaging groove for engaging with an associated said end of the sleeve.

* * * * *